United States Patent [19]

Kaluzhsky et al.

[11] 4,250,012

[45] Feb. 10, 1981

[54] SYSTEM OF CURRENT SUPPLY BUSES FOR ALUMINUM-PRODUCING ELECTROLYZERS

[76] Inventors: Nikolai A. Kaluzhsky, Vasilievsky Ostrov, Sredny prospekt, 6, kv. 23; Semen E. Gefter, ulitsa Chaikovskogo, 18, kv. 6; Igor K. Tsybukov, Tikhoretsky prospekt, 9, korpus 10, kv. 16; Svetozar V. Evdokimov, Lesnoi prospekt, 13/8, kv. 5; Alexei S. Derkach, Detskaya ulitsa, 63, korpus 5, kv. 46; Anatoly M. Tsyplakov, prospekt Kima, 30, kv. 74; Valery P. Lankin, prospekt Nauki, 45, korpus 2, kv. 58; Boris P. Velichko, Nalichnaya, 21, kv. 48, all of Leningrad; Albert A. Kostin, ulitsa Glagoleva, 19, kv. 132, Moscow; Grigory E. Volfson, Budapeshlskaya ulitsa, 10, korpus 2, kv. 101; Vladimir P. Nikiforov, Nalichnaya ulitsa, 49, kv. 8, both of Leningrad, all of U.S.S.R.

[21] Appl. No.: 8,382

[22] Filed: Feb. 1, 1979

[30] Foreign Application Priority Data

Feb. 6, 1978 [SU] U.S.S.R. ..... 2578511

[51] Int. Cl.[3] ..... C25C 3/16

[52] U.S. Cl. ..... 204/243 M; 204/244

[58] Field of Search ..... 204/67, 243 R-247

[56] References Cited

U.S. PATENT DOCUMENTS

| | | | |
|---|---|---|---|
| 3,415,724 | 12/1968 | Heaton et al. | 204/67 |
| 3,617,454 | 11/1971 | Johnson | 204/243 M X |
| 3,640,800 | 2/1972 | Johnson | 204/243 M X |
| 4,072,597 | 2/1978 | Morel et al. | 204/243 M |

FOREIGN PATENT DOCUMENTS

| | | | |
|---|---|---|---|
| 458616 | 2/1975 | U.S.S.R. | 204/243 M |

*Primary Examiner*—G. L. Kaplan
*Assistant Examiner*—D. R. Valentine
*Attorney, Agent, or Firm*—Steinberg & Raskin

[57] ABSTRACT

Disclosed is a system of current-supply buses for aluminum-producing electrolyzers arranged transversely in a row and spaced from each other. The system comprises cathode stacks, anode risers installed in the spaces provided between the electrolyzers, and anode buses for supplying current from the anode risers to electrolyzer anode systems shaped as parallelograms. At least two of the anode risers of each electrolyzer are arranged past the planes passing through the end edges or borders of the anode systems. The proportion of the anode risers so arranged is determined such as to ensure the symmetric distribution of the magnetic field intensity components.

4 Claims, 2 Drawing Figures

SYSTEM OF CURRENT SUPPLY BUSES FOR ALUMINUM-PRODUCING ELECTROLYZERS

FIELD OF THE INVENTION

The present invention relates to the electrolytic production of aluminum, and more particularly to systems of current-supply buses for aluminum-producing electrolyzers. More specifically the present invention relates to an arrangement of the anode risers with respect to the electrolyzer anode systems.

The present invention can be used to best of advantage in system of current-supply buses of aluminum-producing electrolyzers arranged transversely in a row and spaced from each other.

BACKGROUND OF THE INVENTION

In the production of aluminum, it is customary to arrange the electrolyzers in a row at spaces between them, The electrolyzers in the row are connected in series, i.e. the cathode of each electrolyzer is connected through a bus system to the anode system of the next electrolyzer, so that electric current flows through the entire row of the electrolyzers.

In the course of operation of electrolyzers powerful electromagnetic fields are produced by heavy currents flowing through the electrolyzer elements, which substantially influence the process of aluminum electrolysis and the economical characteristics thereof.

With increased power of an aluminum-producing electrolyzer, adverse effect of the magnetic field upon the aluminum electrolysis process is increased. Interaction of the outer magnetic field with the currents flowing through the molten metal causes large-magnitude electromagnetic forces in the latter. These electromagnetic forces give rise to a distorted surface of the liquid cathode metal and to its vigorous circulation.

Considerable warping or buckling of the metal causes electrolyzers to operate at an electrode spacing exceeding the optimum one. This leads to an increase in the voltage across the pot, overexpenditure of electric power and overheating of the melt which adversely effects on the current yield.

As a result of vigorous circulation the molten metal is much more liable to entrapment in the near-the-anode space where it is oxidized by anode gases. Numerous observations have shown that in those zones of the electrolyzer wherein the magnetic field intensity and the level of circulating fluxes reach their peak values, the cathode casing wall deformation occurs and it is in these zones that the inside carbon plates of electrolyzers are most frequently destroyed by the molten metal.

Under the combined effect of gaseous fluxes and electromagnetic forces, waves arise on the surface of the fused aluminum which may result in local shorts that substantially reduce the current yield.

The exploitation of high-power electrolyzers may be economically warranted only if effective measures are developed to counteract the harmful effect of the magnetic field.

Several attempts have been initiated to overcome this disadvantage by modifying the method of current supply of the electrolyzers.

In one system of supplying current to aluminum-producing electrolyzers, the current conductors are split into several parallel buses to form a kind of horizontal plate below the electrolyzers, these conductors alternatively supplying current to the anodes. Although this configuration tends to suppress the magnetic fields, the large number of conductors necessitated interferes with operation of the potlines as well as occupying a good deal of space.

It has also been proposed to locate the current-supply buses at as great a distance from the electrolyzers as possible, while directing the current in adjacent conductors in opposing directions. Again, such an arrangement requires extensive housing and consequent large investment. Moreover, the extra length of the current-supply buses results in excessive power loss.

Investigations of the magnetic fields carried out in recent years both on mocked-up and industrial high amperage electrolyzers, have made it possible to visualise the requirements to the system of current-supply buses of an aluminum-producing electrolyzers, as may be expressed in the following formula:

$$By(O) = O; \frac{\delta By}{\delta x} = \frac{\delta By}{\delta By} \rightarrow O;$$

$$\frac{\delta Bz}{\delta x} = \frac{\delta Bx}{\delta y} \rightarrow O$$

where

By denotes the cross component of the magnetic field,

Bx denotes the longitudinal component of the magnetic field,

Bz denotes the vertical component of the magnetic field.

In other words, the afore-specified requirements imply the symmetry of the cross magnetic field, invariability of the values By and Bx along the axes of the electrolyzer and the requirement of minimum absolute values of Bz effective at the electrolyzer corners, as well as the symmetry of the vertical magnetic field with respect to the electrolyzer axes.

Widely known in the art is a system of current-supply buses for aluminum producing electrolyzers arranged in a row and spaced from each other, comprising cathode stacks, anode risers, and anode buses. In this system, the anode risers are arranged at the ends of the electrolyzer. Such a system of current-supply buses provides a symmetric magnetic field with a fair intensity value of its vertical component. The absolute values of the horizontal components of the magnetic field intensity, however, therewith tend to increase sharply, which results in a vigorous circulation of the molten aluminum in the electrolyzer, disturbed stability of the electrolysis process, and decreased engineering and economical factors.

The system of current-supply buses with the anode risers arranged at the ends of the electrolyzer involves a great proportion of aluminum buses expended on mounting and is characterized by a considerable voltage drop in the cathode stacks.

These disadvantages are eliminated in systems of current-supply buses having an arrangement of the anode risers different from that disclosed.

There is known a system of current-supply buses for aluminum-producing electrolyzers arranged transversely in a row and spaced from each other described in U.S. Pat. No. 3,415,724. This system comprises cathode stacks, anode risers aligned between the electrolyzers, and anode buses for supplying current to electrolyzer anode systems shaped as parallelograms, all the anode risers of each electrolyzer being arranged between the planes extending through the ends of the electrolyzer anode system. Flowing through the current-supply stacks of cathode buses, current is fed from the foregoing electrolyzer side located at the current inlet to the anode risers of the electrolyzer successive in the row, one part of the stacks being arranged under the bottom of the electrolyzer and the other part by-passed around the electrolyzer end portion.

This contributes to the symmetric distribution of all the three components of the magnetic field intensity and a drop in their absolute value, thereby providing stability of the electrolysis process and an increase in its engineering and economic factors.

The arrangement of the anode risers in the space between adjacent electrolyzers of a row cuts considerably the consumption of the aluminum current-supply buses and decreases power loss in the system of current-supply buses as compared with a system wherein the anode risers are arranged at the electrolyzer ends.

However, the presence of a group of the anode risers in the space between adjacent electrolyzers of a row and opposite the anode system interferes notably with mechanization of the handling of the electrolyzers, increases considerably the labor cost, the difficulties increasing as the number of the anode risers in the aforedescribed space increases. Attempts to decrease the number of the anode risers lead to a considerable increase of the magnetic field intensity values, which deteriorates the stability of the electrolysis process and decreases its engineering and economic factors.

SUMMARY OF THE INVENTION

It is an object of the present invention to provide a system of current-supply buses for aluminum-producing electrolyzers which decrease the number of the anode risers arranged in the space between adjacent electrolyzers of a row and opposite the anode system, thereby providing an improved possibility for mechanization of the handling of the electrolyzers resulting in a decreased labor costs, while maintaining symmetric distribution of all the three components of the magnetic field intensity and at their fair absolute value.

With these and other objects in view, there is provided a system of current-supply buses for aluminum-producing electrolyzers arranged transversely in a row and spaced from each other, comprising cathode stacks, anode risers aligned in the spaces between the electrolyzers, and anode buses for supplying current from the anode risers to electrolyzer anode systems shaped as parallelograms, wherein, according to the invention, at least two anode risers of each electrolyzer are arranged past the planes passing through the end borders or edges of the anode systems, the number of the anode risers so arranged being determined such as to ensure the symmetric distribution of the components of the magnetic field intensity.

With such a design, the number of the anode risers arranged in the space between adjacent electrolyzers of a row and opposite the anode system is decreased, thereby providing a possibility for mechanization of the handling of the electrolyzers. The total number of the anode risers of each electrolyzer therewith remains the same which affords no rise of the magnetic field intensity. The symmetry of all the three components of the magnetic field intensity is also observed.

The aforementioned and other objects, as well as the advantages of the present invention will best be understood from a consideration of the detailed description of the preferred embodiments when used in connection with the accompanying drawings, in which:

BRIEF DESCRIPTION OF THE ACCOMPANYING DRAWINGS

FIG. 1 is a schematic top view of a system of current-supply buses for aluminum producing electrolyzers, according to the present invention; and FIG. 2 is a top view of another embodiment of a system of current-supply buses for aluminum-producing electrolyzers, according to the present invention.

DETAILED DESCRIPTION OF THE PREFERRED EMBODIMENTS

Figure 1:
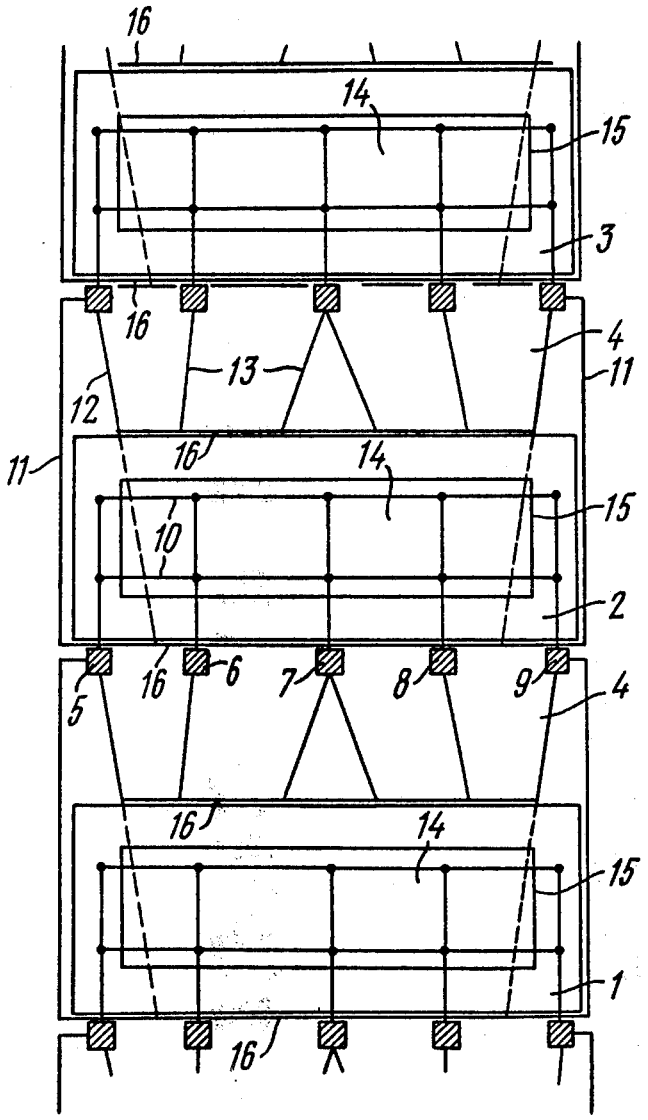

Referring now to FIG. 1, there are schematically shown three electrolyzers 1, 2 and 3 located in the middle of a row of electrolyzers arranged transversely in the row at spaces 4 between them. The system of current-supply buses comprises anode risers 5, 6, 7, 8 and 9, anode buses 10, and cathode stacks 11, 12 and 13. The anode risers 5, 6, 7, 8 and 9 are installed in the spaces 4 provided between the electrolyzers 1, 2 and 3. The anode risers 6, 7 and 8 are arranged opposite anode systems 14 of the electrolyzers 1, 2 and 3, each of the systems being shaped as a parallelogram, and the anode risers 5 and 9 are arranged past the planes passing through end margins 15 of the anode systems 14. The anode risers 5, 6, 7, 8 and 9 are connected to the anode buses 10. The anode risers 5, 6, 7, 8 and 9 of the electrolyzer 3 are connected to cathode rods 16 of the electrolyzer 2, and the anode risers 5, 6, 7, 8 and 9 of the electrolyzer 2 are connected to the cathode rods 16 of the electrolyzer 1 through the cathode stacks 11, 12, 13, arranged in a conventional manner.

Since the anode risers 5 and 9 are arranged past the planes passing through the end margins, edges or borders 15 of the anode systems 14, there is empty space opposite them. This contributes to a possibility for mechanization of the handling of the electrolyzers, thereby decreasing the labor cost for the production of aluminum. The aforedescribed arrangement of the anode risers 5 and 9 doesn't disturb the symmetric distribution of the three components of the magnetic field intensity.

Figure 2:
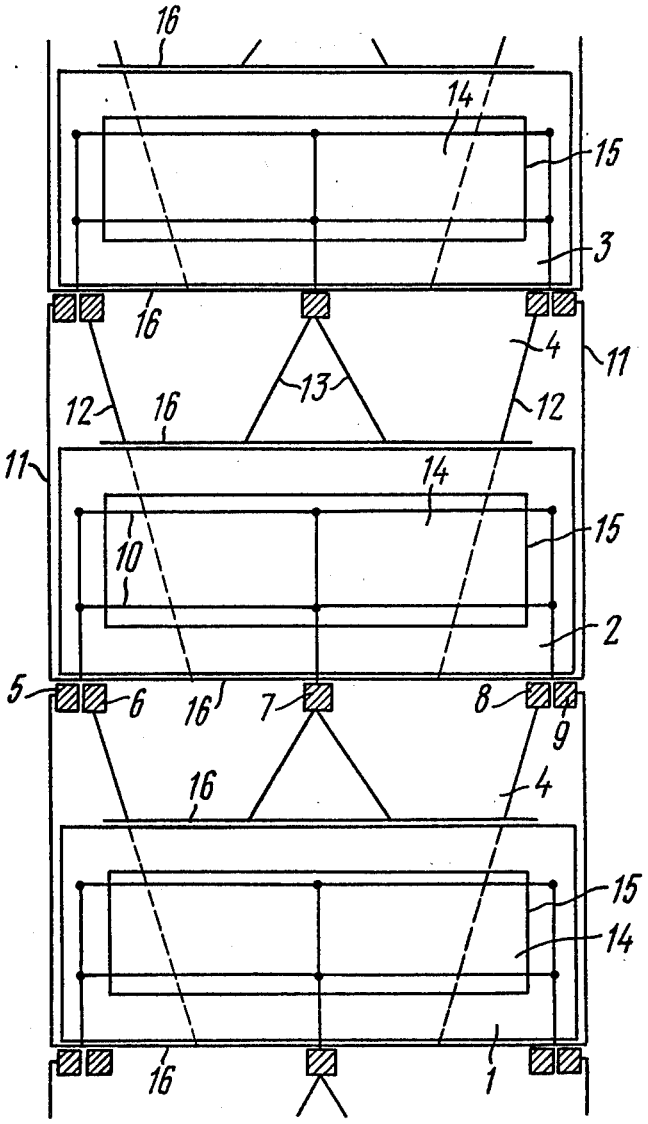

Referring now to FIG. 2, there is shown another embodiment of the system of current-supply buses. In this embodiment, the anode risers 7 of the electrolyzers 1, 2 and 3 are arranged opposite the anode system 14, and the anode risers 5, 6, 8 and 9 are arranged past the planes passing through the end margins 15 of the anode systems 14. As for the remainder, the embodiment of the system of current-supply buses has no fundamental features other than those of the above system.

With such an embodiment of the system of current-supply buses, the empty space opposite the anode systems 14 of the electrolyzers 1, 2 and 3 becomes still greater. As will clearly be understood, it affords still more opportunities for mechanization of the handling of the electrolyzers with all the benefits resulting therefrom. No disturbance of the symmetry of all the three components of the magnetic field intensity occurs, since the same number of the anode risers are arranged past the planes passing through the ends of the anode systems.

It should be noted that the system of current-supply buses can be employed for the electrolyzers having any other number of the anode risers installed in the spaces between the electrolyzers as well. To maintain the symmetry of the distribution of all the three components of the magnetic field intensity, the number of anode risers to be arranged beyond the area defined by the planes passing through the end edges or borders of the anode systems should therewith be the same.

As will be understood by those skilled in the art from the present invention described herein with reference to preferred embodiments thereof, all the objects of the invention can be readily achieved within the scope set forth in the claims. It will also be readily understood that minor changes in the construction of the system of current-supply buses may be made without departing from the spirit of the invention.

All these alteration and changes will be considered to remain within the limits of the spirit and scope of the invention set forth in the claims.

The proposed system of current-supply buses for aluminum-producing electrolyzers makes it possible to increase the mechanization ratio in the handling of the electrolyzers and to decrease the cost of labor. The increase of the mechanization ratio in the handling of the electrolyzers results, in turn, in the stability of the electrolysis process and simultaneous increase of the electrolyzers output. The components of the magnetic field intensity are thereby symmetrically distributed.

We claim:

1. A system of current supply buses for aluminum-producing electrolyzers arranged transversely in a row in spaced relation with each other, said system having a plurality of cathode stacks and a plurality of anode risers in each space between next-adjacent electrolyzers, anode systems and anode buses electrically connected to the anode risers for supplying current from said anode risers to said anode systems, each of said anode systems being shaped as a parallelogram with a first pair of spaced parallel border edges and a second pair of spaced parallel border edges transverse to the first pair of edges, at least two anode risers of each of said electrolyzers being positioned beyond planes passing through the second pair of edges of said anode systems and outside the area bounded by said planes, the proportion of said anode risers positioned beyond said planes relative to the total number of said anode risers being selectec to insure symmetric distribution of the magnetic field intensity.

2. A system as claimed in claim, 1 wherein each of the second pair of edges of each of said anode systems is shorter than each of the first pair of edges of each of said anode systems.

3. A system as claimed in claim 1, wherein a greater number of said anode risers is positioned within the area bounded by said planes than those positioned outside the area bounded by said planes.

4. A system as claimed in claim 1, wherein a smaller number of said anode risers is positioned within the area bounded by said planes than those positioned outside the area bounded by said planes.

* * * * *